US005241805A

United States Patent [19]

Johnson

[11] Patent Number: 5,241,805

[45] Date of Patent: Sep. 7, 1993

[54] BOTTLE PACKER FOR IN LINE CASES

[75] Inventor: Lloyd D. Johnson, Portland, Conn.

[73] Assignee: Standard-Knapp, Inc., Portland, Conn.

[21] Appl. No.: 938,490

[22] Filed: Aug. 31, 1992

Related U.S. Application Data

[63] Continuation of Ser. No. 738,266, Jul. 31, 1991, abandoned.

[51] Int. Cl.[5] ..... B65B 5/08; B65B 35/30

[52] U.S. Cl. ..... 53/534; 53/251; 53/543

[58] Field of Search ..... 198/419.3, 459, 479, 198/722; 53/48.1, 244, 246, 250, 251, 443, 448, 475, 534, 543, 580

[56] References Cited

U.S. PATENT DOCUMENTS

| | | | |
|---|---|---|---|
| 2,699,278 | 1/1955 | Wysocki | 53/534 |
| 2,805,755 | 9/1957 | Jones | 53/48.1 X |
| 2,978,854 | 4/1961 | Fairest | 53/534 X |
| 3,141,274 | 7/1964 | Nigrelli et al. | 53/48.1 |
| 3,553,927 | 1/1971 | Anglade | 53/448 |
| 3,805,476 | 4/1974 | Kawamura et al. | 53/534 X |
| 4,041,677 | 8/1977 | Reid | 198/419.3 X |
| 4,389,832 | 6/1983 | Calvert | 53/534 X |
| 4,896,474 | 1/1990 | Osteen et al. | 53/534 X |
| 4,949,531 | 8/1990 | Langenbeck et al. | 53/534 |

*Primary Examiner*—John Sipos
*Assistant Examiner*—Linda B. Johnson
*Attorney, Agent, or Firm*—McCormick, Paulding & Huber

[57] ABSTRACT

Articles, such as small plastic bottles, or six packs consisting of such bottles, are moved by line pressure down an inclined ramp into a load station where plastic trays are continuously filled with these articles. The trays are indexed by a flight bar conveyor that raises each tray, to be in position to index the next tray, and driven separator discs above the articles have lugs that move between selected article rows to index groups of the articles as they are loaded into the tray.

7 Claims, 9 Drawing Sheets

BOTTLE PACKER FOR IN LINE CASES

CROSS REFERENCE TO RELATED APPLICATION

This application is a streamlined continuation of application Ser. No. 738,266, filed Jul. 31, 1991, now abandoned.

This invention relates generally to packers for loading plastic and/or glass bottles into upwardly open cases or trays which are adapted to receive two or more side-by-side columns of bottles in aligned rows. Line pressure from a conveyor moves the bottles across a ramp. Support for the bottles at the load station may be provided by neck ring guides, or by virtue of the fact that the bottles are prepackaged in cartons or six packs or by other suitable means. The trays or cases move upwardly from below the path of the article columns into the load station where each tray is elevated slightly at its rear or aft end by a flight bar conveyor system that is used to synchronize the trays with an overrunning series of parallel collating wheels that are provided with protuberances for downward movement between adjacent columns of articles to form individual groups of articles for deposit in each of the generally rectangular cases or trays.

BACKGROUND OF THE INVENTION

Continuous motion packers of the type adapted to handle relatively large plastic soda bottles in two columns are currently available. See for example the apparatus disclosed in U.S. Pat. No. 4,901,501 and assigned to the assignee herein. The usefulness of such an apparatus for packing plastic bottles in two or more columns or lanes poses problems for such a packer, and typically, trays for transporting smaller bottles do not have pockets uniformly spaced with respect to one another as do the trays for handling large plastic bottles.

U.S. Pat. No. 5,020,306 entitled CONTINUOUS MOTION PACKER FOR FEEDING CONTAINERS IN END-TO-END PACKING CASES and also assigned to the assignee herein teaches that an apparatus can be provided for handling two side-by-side columns of containers or bottles even where the pockets in which the bottles are to be deposited are not equally spaced in the longitudinal direction. However, as in the apparatus of U.S. Pat. No. 4,901,501 only two side-by-side columns or lanes of plastic soda bottles can be accommodated.

The general purpose of the present invention is to provide a packer capable of handling two or more columns of bottles and depositing such articles into upwardly open plastic cases or trays such that orderly slugs or charges of articles are deposited in each tray as the trays move end-to-end through the load station.

SUMMARY OF INVENTION

In accordance with the present invention an apparatus is disclosed for handling two or more columns of bottles and continuously depositing these bottles into upwardly open cases while the bottles and the cases move continuously in a downstream direction.

A load station is provided to receive the cases conveyed to the load station by conveyor means including a flight bar conveyor system where the flight bars are spaced from one another a distance slightly less than the length of each case to be handled at the load station. This affords a convenient means for timing and positioning the cases so that they can be synchronized with movement of the articles to be packed.

Article conveying means is provided for moving the articles by line pressure down an inclined path toward the load station where groups of the articles are to be mated with an associated case. The articles may be bottles or subgroups of bottles.

Where the bottles are prepackaged in subgroups such as six packs, as for example by a shrink film wrapping around six soda bottles the prepackaged groups can be fed by line pressure and by gravity down an inclined ramp toward the load station. Where the bottles are to be packaged individually, as for example in a packing case of the type adapted to transport 24 bottles in four columns of six rows, the bottles may be provided on an inclined ramp followed by further handling toward and into the load station by neck ring guides. These guides afford a more convenient and orderly system for handling individual bottles as they move from the inclined ramp into the load station and into the above described indexed case as it to moves through the load station.

Article collating means is provided at the load station and includes means movable between the columns of articles in certain selected rows to control the articles in these rows and to separate the articles into associated groups as described above. Preferably, said means comprises a rotating series of discs or wheels arranged on a common shaft for rotation on an axis spaced above the upstream or inlet end of the load station. These wheels or discs have protuberances which move between the adjacent selected rows of articles to time and position the articles in relationship to the underlying flight bar conveyor for the cases. More specifically, these protuberances move along an arcuate path from initial positions above the articles at a point spaced upstream from the load station and move arcuately and downwardly through an inclined plane defined by the neck ring guides or the necks of the bottles themselves to a position between adjacent articles in the selected rows. These lugs or protuberances move downstream at a controlled speed to create a predetermined space between the adjacent article rows to accommodate the front and rear panels of the case about to enter the load station and the case then transiting the load station.

DETAILED DESCRIPTION OF FIGS. 1–5

Figure 1:
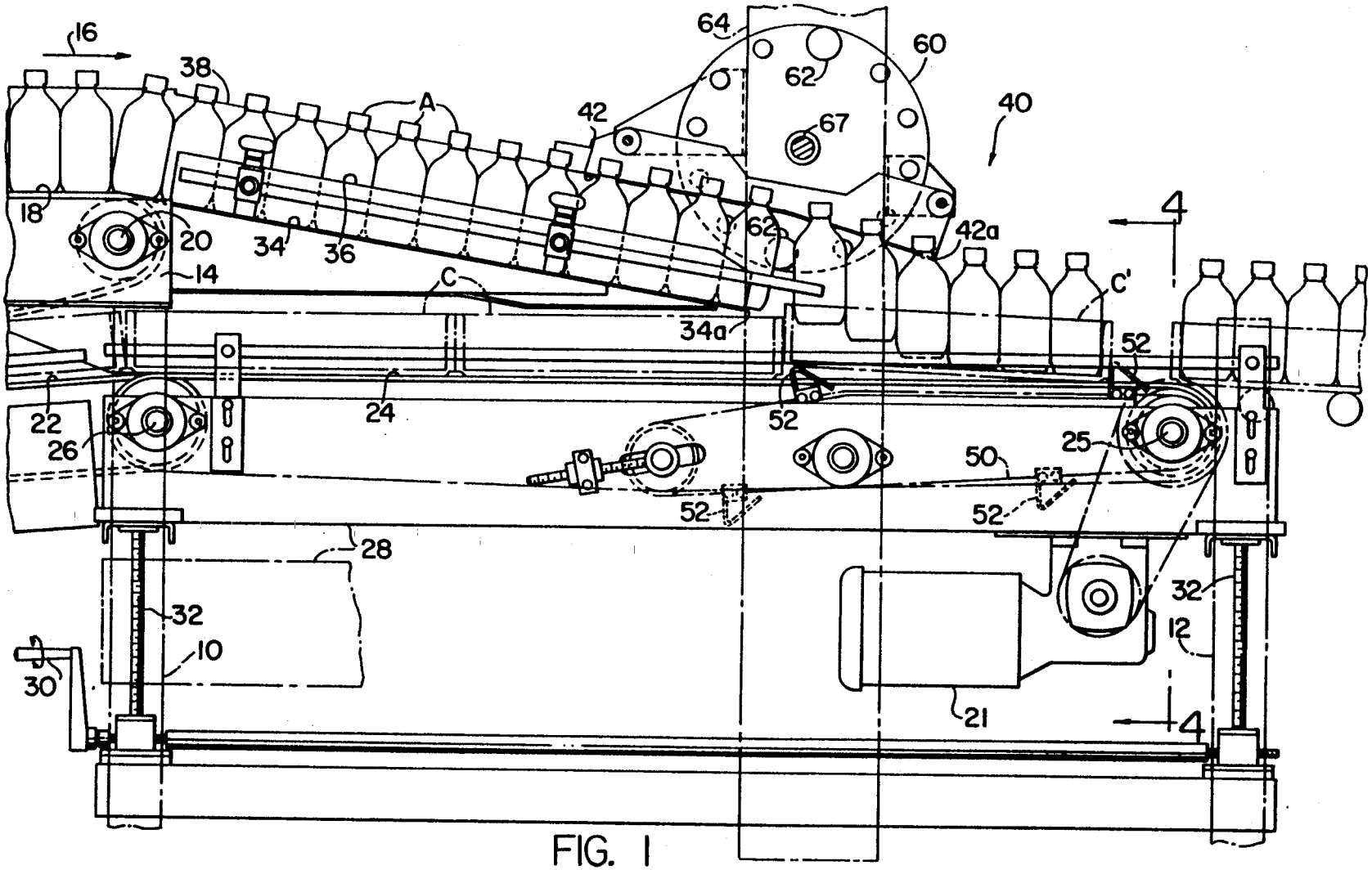
FIG. 1 is a side elevational view with portions broken away or omitted illustrating an apparatus for loading articles into upwardly open plastic trays, the articles being individual plastic bottles.

Turning now to the drawings in greater detail, FIG. 1 illustrates an apparatus according to the present invention as including a fixed frame having legs 10 and 12 for supporting the frame. The frame includes a superstructure indicated generally at 14 supporting a conveyor for moving articles in a plurality of side-by-side columns in the general direction of the arrow 16. This article conveyor 18 is driven from the head shaft indicated generally at 20 by a drive motor 15 best shown in FIG. 2.

Figure 2:
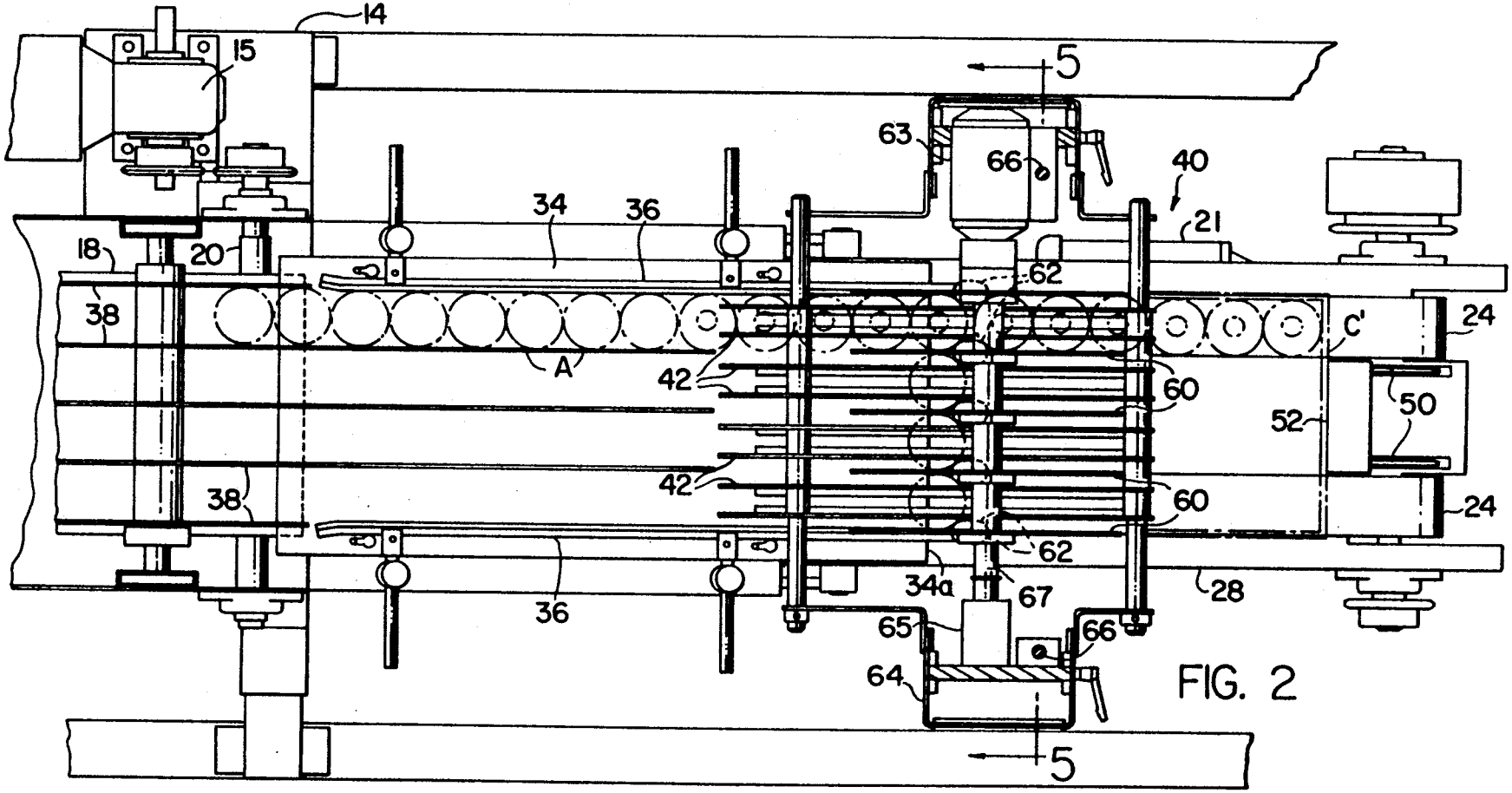
FIG. 2 is a plan view portions omitted or broken away illustrating the apparatus of FIG. 1.

Plastic trays or cases to be loaded are fed below the path of the articles on a case conveyor 22 which provides cases C, C in end-to-end relationship to a pair of spaced apart case conveyors 24, 24 as best shown in FIG. 2.

The head shaft 26 for the case conveyor 22 and the head shaft 25 for the spaced apart case conveyors 24, 24 are provided on a beam 28 which is fixed for a particular setup, that is for loading articles of a particular geometry in a particular size case. However, the beam 28 is vertically adjustable, as for example by the crank 30 through a system of four vertically oriented shafts 32 provided in the legs 10 and 12. More particularly, the beam 28 can be lowered from the position shown in full lines to that illustrated generally in broken lines at 28 in FIG. 1. This adjustability permits handling cases of different height as well as handling articles of different height. A drive motor 21 operates both conveyor 22 and conveyors 24, 24.

The side-by-side lanes or columns of articles are moved by line pressure, from the article conveyor 18, onto an inclined deadplate or ramp indicated generally at 34 in FIGS. 1 and 2. Side guides 36, 36 are provided at the sides of the articles as they move down the inclined ramp 34, and lane dividers 38, 38 are also provided for supporting the articles in side-by-side lanes and in a plurality of side-by-side columns for movement down the ramp 34 toward a load station indicated generally at 40 in FIGS. 1 and 2.

Figure 3:
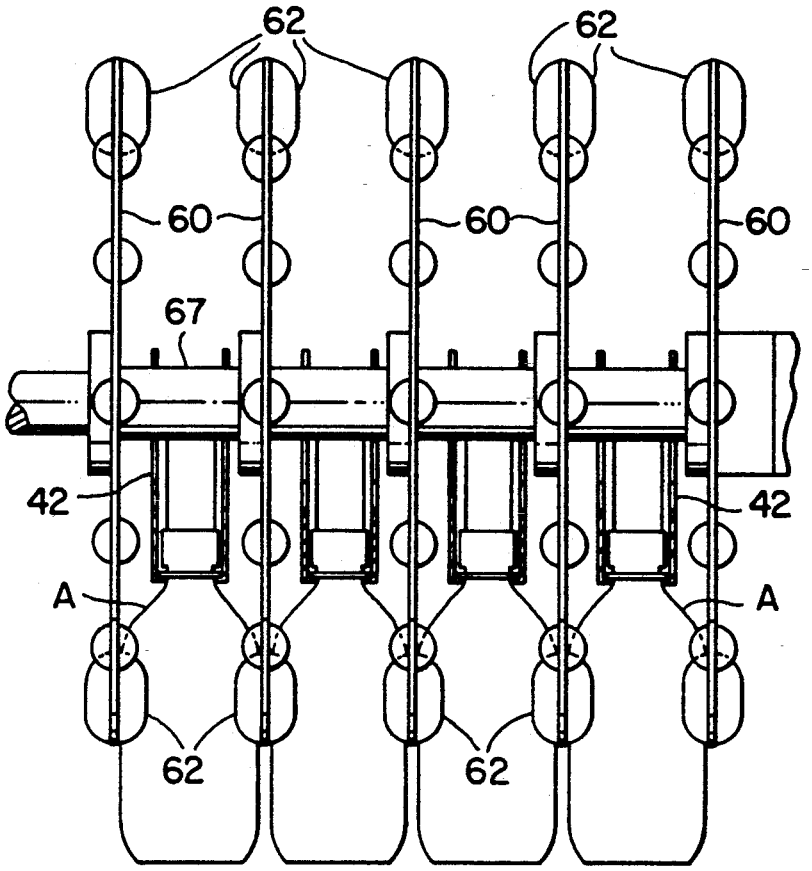
FIG. 3 is a sectional view taken generally on the line 3—3 of FIG. 2.
Figure 8A:
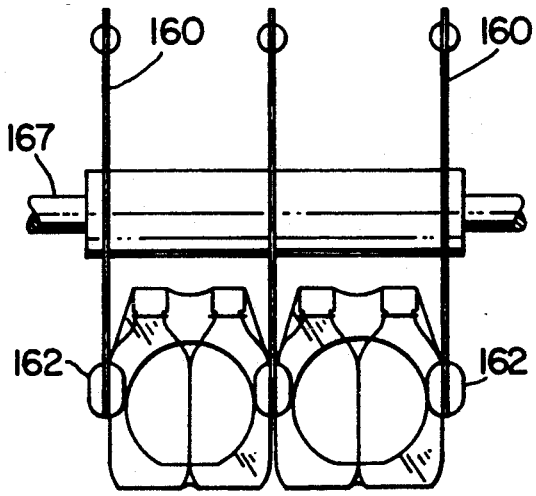
FIG. 8A is a schematic view similar to that of FIG. 8, but illustrating only the rotating discs with the lugs provided thereon for purposes of separating adjacent rows of articles.

The ramp 34 has a downstream edge 34*a* which is provided just short of the load station 40 so that the articles must be further guided into the load station. Inclined neck ring guides indicated generally at 42 in FIGS. 1 and 2 are shown as a preferred means for guiding the columns of plastic bottles into the load station. However, glass bottles with caps attached provide the same opportunity for such a neck ring guide structure. As used in this disclosure and the appended claims the term neck ring guide is intended to cover such equivalent structure as will handle capped glass bottles. These neck ring guides define slots for slidably receiving the articles as best shown in FIG. 3. The upstream ends of these neck ring guides are provided well upstream of the downstream edge 34*a* of the ramp, and the downstream edges 42*a* of the neck ring guides are provided at a position approximately at the middle of the load station 40 (that is in the middle of the case C' shown at the load station 40 in FIG. 1).

As mentioned previously the cases C, C are fed in the downstream direction initially by the case conveyor 22 and then by the laterally spaced vertically adjustable case conveyors 24, 24. Case indexing means in the form of a flight bar conveyor 50 controls the case moved through the load station 40 and each flight bar moves upwardly between the laterally spaced case conveyors 24, 24 as shown in FIGS. 1 and 2. The flight bars 52, 52 are spaced apart a distance slightly less than the length of a case C to be loaded, and thus each flight bar moves upwardly through the plane defined by the spaced case conveyors 24, 24 so as to lift the trailing end of each case in turn as the case moves through the load station 40. This lifting action not only serves to assist in the loading of the articles in the case, but also serves to control the case behind each flight bar so as to permit timing of case movement with the movement of the articles being loaded.

The articles are controlled in their movement so as to correlate with movement of the underlying case by rotating discs 60, 60 provided on a common shaft 67 and driven by a drive motor 63 best shown in FIG. 2. Each disc 60 has at least one lug or protuberance provided adjacent its periphery as indicated generally at 62. Preferably, two such lugs 62, 62 are provided on each disc 60 and the geometry of the disc is such that the radius of the disc corresponds roughly to the height of an article to be loaded and so that the circumference of the disc is related to the length of the case to be loaded. More particularly, with two protuberances 62, 62 on each disc 60 the circumference of the disc is roughly equal to twice the length of the case C.

Figure 4:
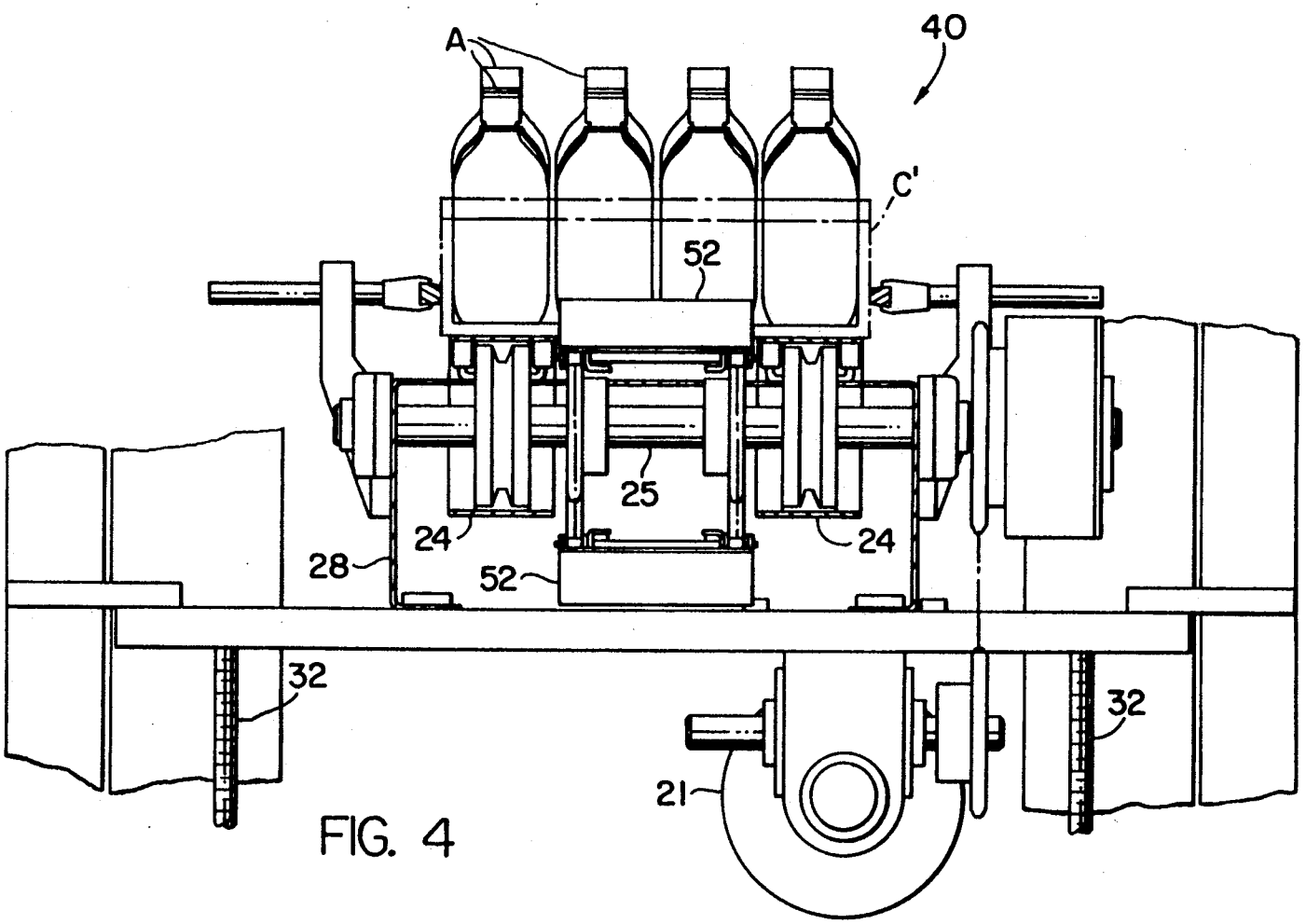
FIG. 4 is a sectional view taken generally on the line 4—4 of FIG. 1.

FIG. 4 shows the case C' being loaded. Four columns of articles are guided between the side guides 36, 36 as the case is controlled by the forward flight bar 52. The underlying spaced apart case conveyors 24, 24 actually travel at a speed somewhat greater than that of the flight bar 52 so that the flight bar 52 acts to hold back the case C' and closely control its movement relative to the overhead series of discs 60.

Figure 5:
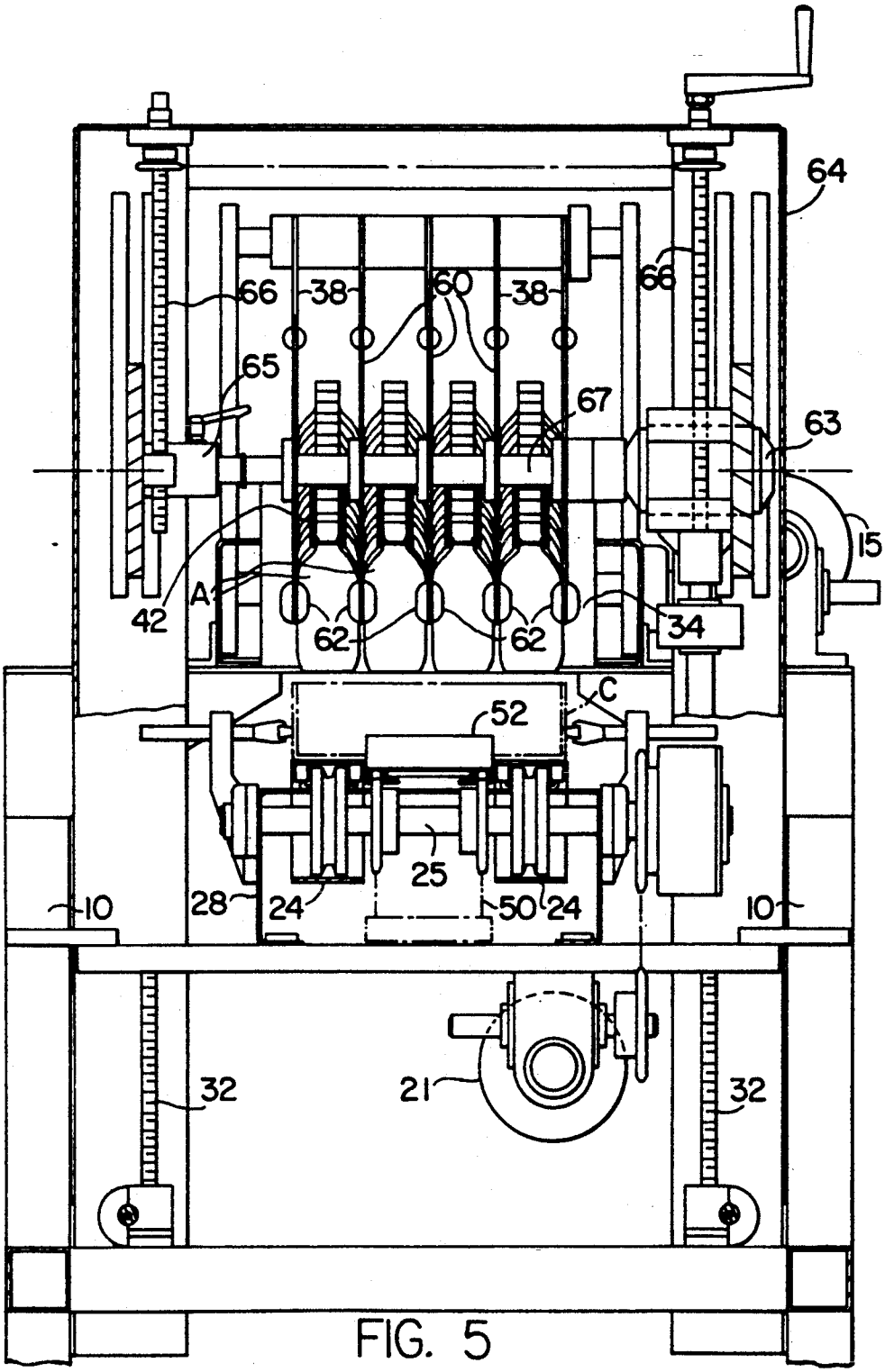
FIG. 5 is a vertical section taken generally on the line 5—5 of FIG. 2.

FIG. 5 shows the drive motor 63 for rotating the discs 60. Five discs are provided in a subassembly which is readily removable for replacement by a subassembly (not shown) with discs of different diameter for handling articles of different size. FIG. 5 also shows that the motor 63 and its opposed bearing block 65 are vertically adjusted in the fixed frame 64. A pair of parallel jack screws 66, 66 are rotatable together so as to permit adjustment to be made in the vertical height of the axis of rotation of shaft 67 in the disc assembly 60, 60. As best shown in FIG. 1 the assembly for so supporting the rotating discs 60 is so constructed that the neck rings guides 42, 42 are also vertically adjustable with the disc assembly and shaft 67.

In summary the articles move downstream in side-by-side rows, being separated by lane dividers for movement on an inclined path defined in part by the ramp 34 and in part by the neck ring guides 42. The cases C, C are moved toward the load station along a path below the articles and the position of each case is controlled by a flight bar conveyor 50 provided between the spaced apart conveyor belts 24, 24.

Article synchronizing means in the form of discs driven in timed relation to these flight bars 52, 52 are provided with at least one protuberance, and preferably two diametrically opposed lugs, for separating selective article rows. These discs 60 may have smaller lugs or protuberances between other article rows to assure that the operative lugs 62, 62 move into positions between the proper article rows to form groups or slugs of articles of the proper geometry for the case to be loaded.

Each row of articles drops off the ends of the neck ring guides at approximately the midpoint of the case at the load station 40. At this point the articles are already down inside the case (see FIG. 1) and hence drop less than one-half the height of the case.

DETAILED DESCRIPTION OF FIGS. 6–8A

Turning next to a discussion of FIGS. 6–8A inclusively an apparatus of slightly different construction is illustrated for handling six pack shrink wrap container groups for loading in cases similar to those shown and described in their previous embodiment of FIGS. 1–5. The individual articles or bottles may be small plastic injection molded soda bottles of the type shown in the forgoing description of FIGS. 1–5, but these containers are grouped in individual six packs to form more conveniently handled six pack units or articles not only during the loading of the case in the machine to be described, but also for further handling by the retailer or customer.

The apparatus of FIGS. 6–8A includes the same fixed frame as described previously with legs 10 and 12, and with a vertically adjustable beam 28 for supporting the head shafts of both the case conveyor 22 and the spaced apart case conveyors 24. As in the previously described embodiment this beam 28 may be adjusted vertically for purposes of handling cases of different height and/or receiving articles of different height.

Figure 6:
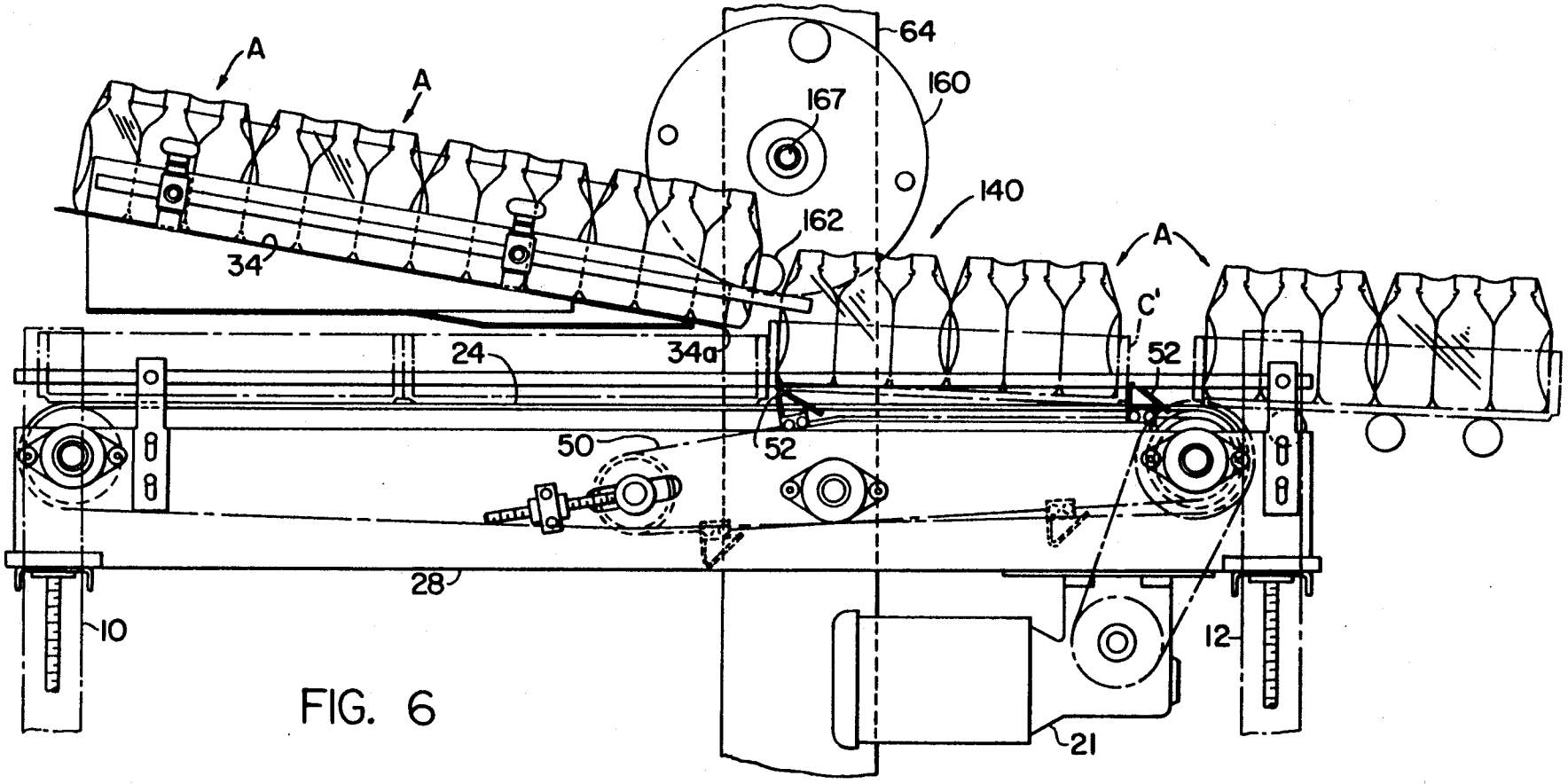
FIG. 6 is a side elevational view similar to that of FIG. 1, but illustrating an alternative embodiment of the present invention wherein the articles to be handled are six packs of prepackaged bottles provided in shrink wrapped subassemblies.
Figure 7:
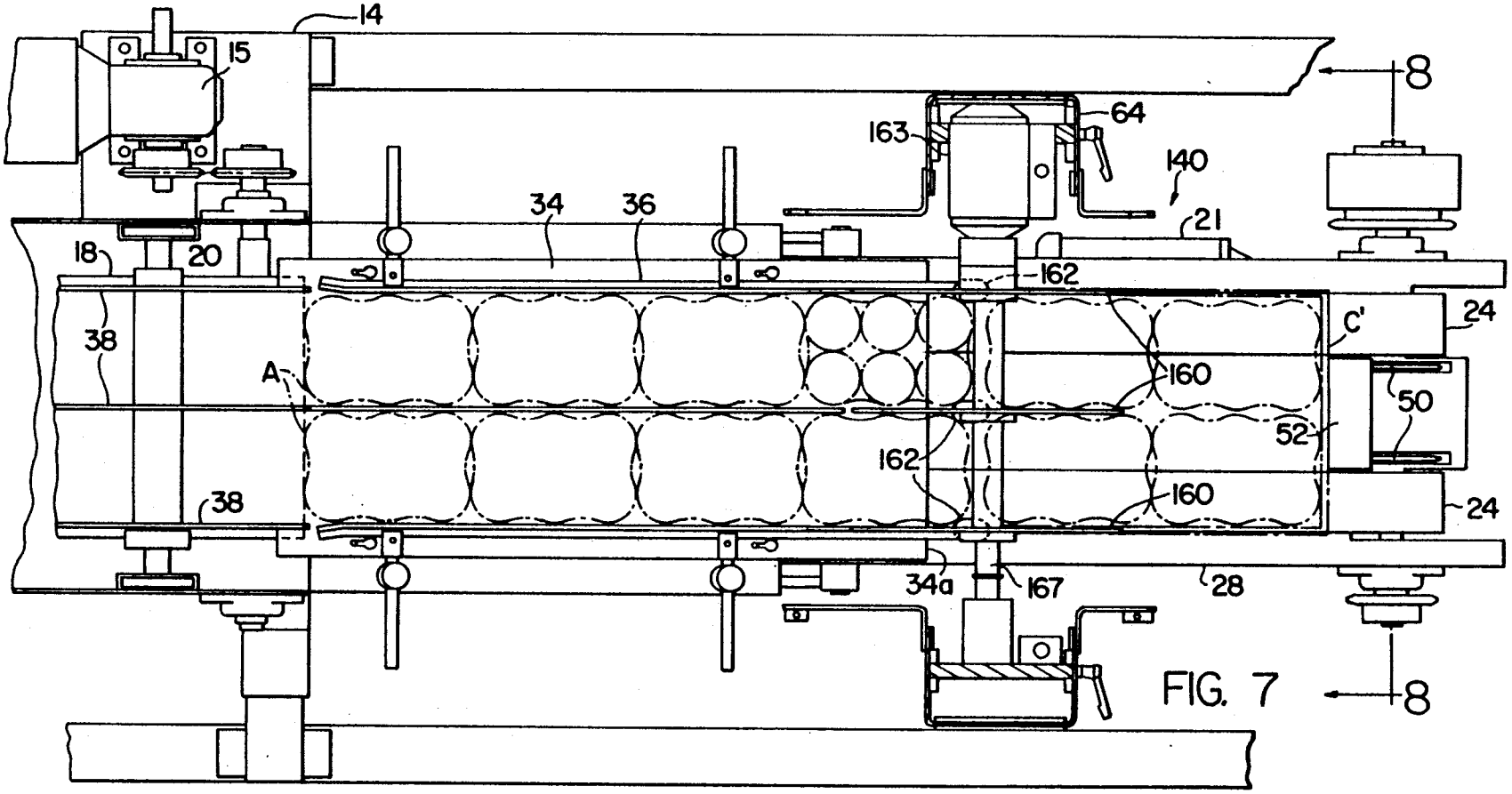
FIG. 7 is a top plan view of the apparatus illustrated in FIG. 6.

Comparing FIGS. 6 and 7 it will be apparent that each article comprises a six pack carton which has been prepackage to provide a six pack configuration as described above. Two side-by-side lanes are provided for the articles A, A as these articles move down the inclined ramp 34. The downstream end 34*a* may be provided just short of the entry to the load station 40 as in the previously described embodiment. However, neck ring guide need not be utilized because of the fact that the individual plastic containers or bottles have been partially preassembled to form the six pack carton shown. The six pack cartons provide sufficient stability for handling at the load station without necessity for supporting the usual bottles from neck ring guides.

As in the previously described embodiment the six pack carton units or articles are controlled in their movement so as to correlate with movement of the underlying case by rotating discs 160, 160. These discs are provided on a common shaft 167 and driven by a drive motor 163 as best shown in FIG. 7. Each disc 160 has at least one lug or protuberance provided adjacent its pheriphery as indicated generally at 162, and preferably two such lugs are provided on each disc 160 as in the previously described embodiment.

The geometry of these is such that the radius of the disc corresponds roughly to the height of an article or six pack unit to be loaded, and so that the circumference of the disc is related to the length of the case to be loaded. As in the previously described embodiment, with two protuberances 162, 162 provided on each disc 160, the circumference of the disc is roughly equal to twice the length of the case C.

Figure 6A:
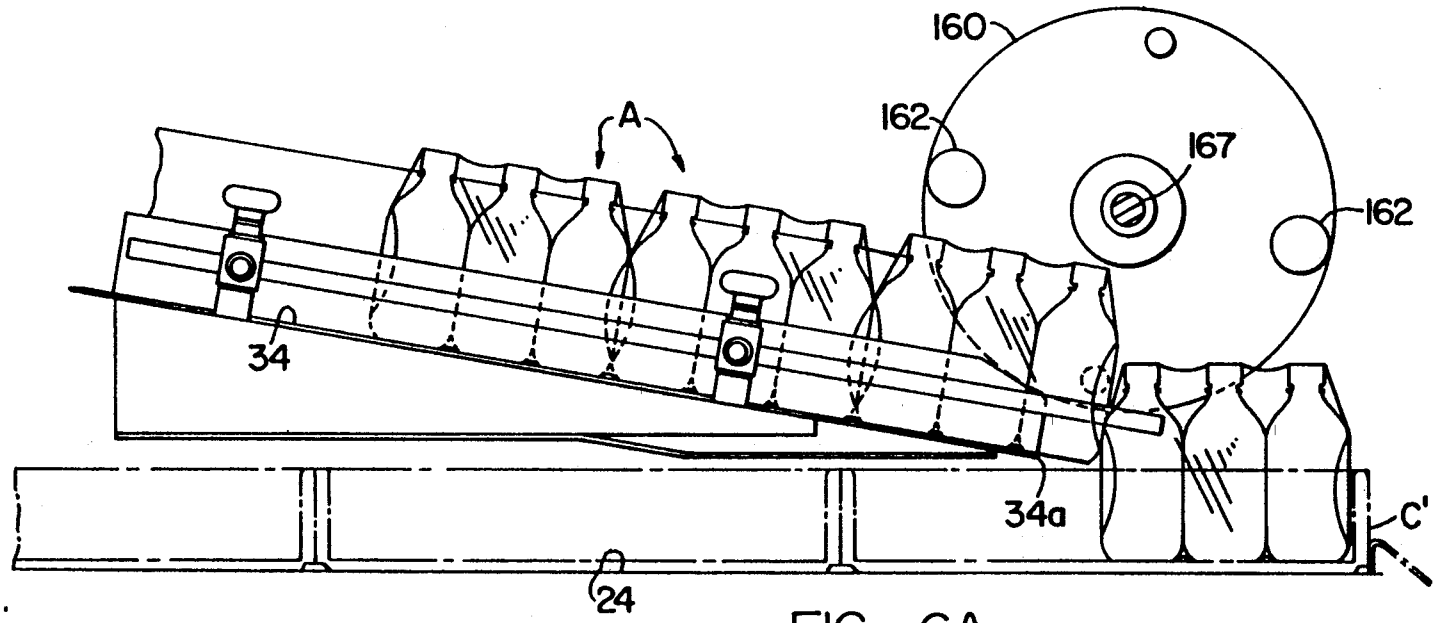
FIG. 6A is a view similar to FIG. 6, but illustrating the configuration for the articles at a slightly later instant of time.

Comparing FIG. 6 and FIG. 6A the case being loaded will receive one article as shown in FIG. 6A followed by a second article as best shown in FIG. 6 as the case C′ proceeds through the load station with its motion uninterrupted except for the fact that the article synchronizing means in the form of the discs 160 will serve to match the speed of forward movement for these articles with the speed of forward movement of the cases, the latter being controlled by the flight bar conveyor 50. The flight bar conveyor on the embodiment illustrated in FIGS. 6–8A is identical to that shown and described previously to the embodiment of FIGS. 1–5. As in the previously described embodiment the support for the article indexing means in the form of disc subassembly is vertically adjustable in a fixed framework as described previously, and as shown at 64 in FIG. 7.

Figure 8:
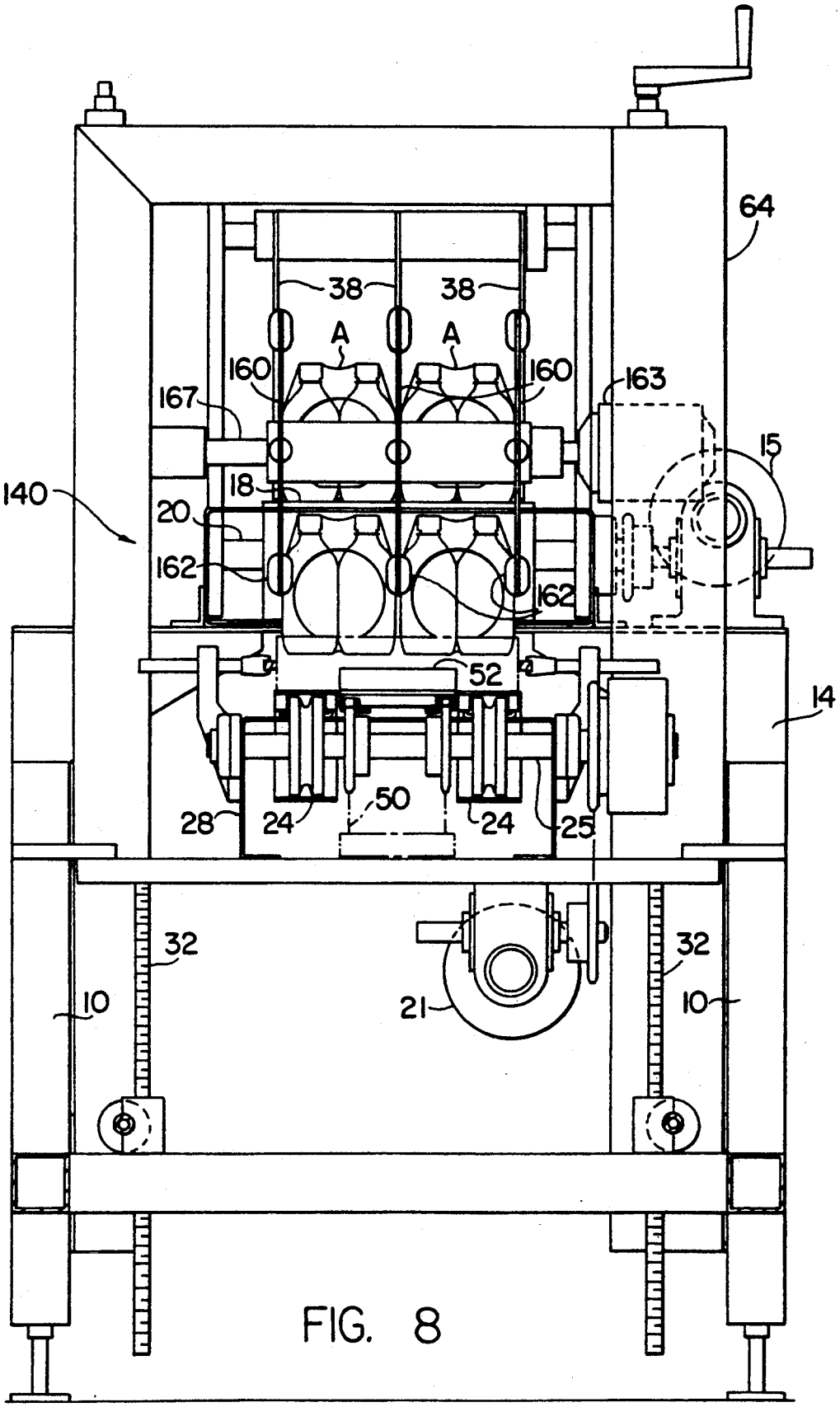
FIG. 8 is a right hand end view of the apparatus illustrated in FIGS. 6–7 inclusively taken generally on the line 8—8 of FIG. 7.

FIG. 8 shows the shaft 167 for rotatably supporting the disc 160, and it will be apparent that this shaft 167 has couplings at each end so that the shaft can be easily removed for replacement by disc subassemblies of different geometry for accommodating articles of different geometry.

In summary, the articles A, A move downstream in side-by-side relationship being separated by fixed lane dividers so that the articles will move down the inclined path defined solely by the ramp 34. The cases C, C are moved toward the load station 40 along a path below the articles and each case is indexed by a flight bar conveyor 50 provided between the spaced apart conveyor belts 24, 24. Article synchronizing means in the form of discs 160 which are driven in timed relationship to the flight bars 52, 52 are provided with at least one protuberance, and preferably two diametrically opposed lugs, for separating selective article rows. These discs 160 may have smaller lugs or protuberances between other article rows within a particular group to be loaded in a case in order to assure that the operative lugs 162 move into position between the proper article rows to form groups or slugs of articles of the proper geometry for the case to be loaded.

Each row of articles drops off the downstream end 34*a* of the ramp 34 at approximately the midpoint of a load station 140 which load station 140 is defined slightly upstream of the load station 40 referred to in the previously described embodiment because of the absence of the neck ring guides. At this point, at the load station, the articles are loaded in orderly rows inside the case (see FIGS. 6 and 6A). The articles comprising the six pack carton shown in FIGS. 6 and 6A will generally drop a vertical distance equal approximately to the height of the case C to be loaded.

I claim:

1. Apparatus for loading columns of articles into upwardly open rectangular cases wherein the cases have end walls and wherein the articles in the columns are arranged adjacent one another, said apparatus comprising:

case conveying means for continuously feeding cases end-to-end to and through a load station, article moving means for advancing the articles in N columns, including outside columns, and including a ramp across which the articles move in side-by-side rows by line pressure, said load station provided at a downstream end of said ramp, a plurality of N plus one rotating article separator discs, each disc having an axis of rotation perpendicular to said columns, said discs having first article engaging lugs acting only on predetermined article rows for retarding certain of said rows and creating gaps between successive groups of articles, means for rotating certain of said discs around their axes between the article columns, and said discs having surface segments that move through said load station with the article being loaded, said first article engaging lugs acting on said predetermined article rows in timed relation with arrival of said end-to-end cases at said load station whereby said gaps coincide with the adjacent front and rear end walls of adjacent cases at said load station, said first article engaging lugs defined by circumaxially spaced protuberances located on said surface segments of each disc adjacent the disc circumference and extending in a direction parallel to said axial direction, and said number of columns N being a number greater than two, and other of said discs rotatable alongside and outside of the outside columns and also having circumaxially spaced protuberances located on inwardly facing surface segments adjacent said other disc circumferences.

2. Apparatus according to claim 1 wherein said certain article separator discs also have second article engaging lugs smaller than said first lugs for moving between other article rows within each said article group to guide each row of articles into the cases traversing said load station said ramp being downwardly inclined so that the articles merge with the cases at said load station.

3. Apparatus according to claim 2 wherein said discs rotate on a horizontal axis spaced above said load station, said discs having a circumference of approximately twice the longitudinal dimension of said cases, and a radius approximately equal the height of the articles being loaded.

4. Apparatus according to claim 2 wherein said downwardly inclined article supporting means comprises inclined neck ring guides supporting articles with necks for movement of said articles through said load station, said discs rotating between said neck ring guides.

5. Apparatus according to claim 4 wherein said discs rotate on a horizontal axis spaced above said load station, said discs having a circumference of approximately twice the longitudinal dimension of said cases, and a radius approximately equal the height of the articles being loaded.

6. Apparatus according to claim 5 wherein said certain disc has two of said first article engaging lugs, and wherein said discs are driven at a rotational speed that moves said lugs at a tangential speed corresponding to the lineal speed of said cases at said load station.

7. Apparatus according to claim 6 wherein said downwardly inclined article supporting means comprises said inclined ramp across which the articles are moved by line pressure and said neck ring guides, and further comprises said neck ring guides extending beyond said ramp downstream end, said neck ring guides cooperating with said lugs to suspend the articles vertically at said load station case indexing means at said load station, said case indexing means comprising flight bars spaced apart by a distance slightly less than the length of the case to be loaded, and each such flight bar being movable upwardly at said load station through a horizontal plane defined by said case conveying means to tilt each case forwardly as it traverses the load station.

* * * * *